US008887525B2

(12) United States Patent
Harman et al.

(10) Patent No.: US 8,887,525 B2
(45) **Date of Patent: *Nov. 18, 2014**

(54) HEAT EXCHANGE AND COOLING SYSTEMS

(75) Inventors: Jayden David Harman, San Rafael, CA (US); Thomas Gielda, Saint Joseph, MI (US)

(73) Assignee: Pax Scientific, Inc., San Rafael, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/961,366

(22) Filed: Dec. 6, 2010

(65) Prior Publication Data

US 2011/0113792 A1 May 19, 2011

Related U.S. Application Data

(63) Continuation of application No. 12/876,985, filed on Sep. 7, 2010, now Pat. No. 8,365,540.

(60) Provisional application No. 61/240,153, filed on Sep. 4, 2009.

(51) Int. Cl.

| | |
|---|---|
| ***F25B 3/00*** | (2006.01) |
| ***F25B 9/02*** | (2006.01) |
| ***F25B 1/00*** | (2006.01) |
| ***F28D 21/00*** | (2006.01) |

(52) U.S. Cl.

CPC ..... *F28D 21/00* (2013.01)
USPC ..... 62/500; 62/5; 62/116

(58) Field of Classification Search

USPC ..... 62/5, 116, 500; 239/589, 589.1, 591, 239/592, 593, 594, 595, 601

See application file for complete search history.

(56) References Cited

U.S. PATENT DOCUMENTS

| | | | |
|---|---|---|---|
| 1,860,447 | A | 5/1932 | Bergdoll |
| 2,116,480 | A | 5/1938 | Russell |
| 2,518,202 | A | 8/1950 | Servel Inc. |
| 2,905,731 | A | 9/1959 | Phillips Petroleum Co. |
| 2,928,779 | A | 3/1960 | Weills et al. |
| 3,228,848 | A | 1/1966 | Fellows |
| 3,425,486 | A | 2/1969 | Burton et al. |

(Continued)

FOREIGN PATENT DOCUMENTS

| | | |
|---|---|---|
| EP | 1 080 648 | 7/2001 |
| EP | 1 720 012 | 11/2006 |

(Continued)

OTHER PUBLICATIONS

"Nozzle Applet" Published by Virginia Polytechnic Institute and State University (Virginia Tech) and retrieved on May 10, 2011 at http://www.engapplets.vt.edu/fluids/CDnozzle/cdinfo.html.

(Continued)

*Primary Examiner* — Mohammad M Ali
*Assistant Examiner* — Daniel C Comings
(74) *Attorney, Agent, or Firm* — Lewis Roca Rothgerber LLP

(57) ABSTRACT

A heat exchanger may be associated with a heat transfer system to promote flow of heat energy from a heat source to a multi-phase fluid. The heat exchanger may be associated with an expansion portion. The fluid may be a refrigerant to which nano-particles may be added. Embodiments of the present invention may be implemented in an air-conditioning system as well as a water heating system.

18 Claims, 11 Drawing Sheets

(56) References Cited

U.S. PATENT DOCUMENTS

| | | | | |
|---|---|---|---|---|
| 3,510,266 | A | 5/1970 | M. Midler, Jr. | |
| 3,548,589 | A | 12/1970 | Cooke-Yarborough | |
| 3,552,120 | A | 1/1971 | Beale | |
| 3,621,667 | A * | 11/1971 | Mokadam | 62/116 |
| 3,866,433 | A | 2/1975 | Krug | |
| 4,031,712 | A | 6/1977 | Costello | |
| 4,043,769 | A | 8/1977 | Nishino et al. | |
| 4,044,558 | A | 8/1977 | Benson | |
| 4,057,962 | A | 11/1977 | Belaire | |
| 4,070,131 | A | 1/1978 | Yen | |
| 4,089,187 | A | 5/1978 | Schumacher et al. | |
| 4,201,263 | A | 5/1980 | Anderson | |
| 4,333,796 | A | 6/1982 | Flynn | |
| 4,442,675 | A | 4/1984 | Wilensky | |
| 4,499,034 | A | 2/1985 | McAllister, Jr. | |
| 4,858,155 | A | 8/1989 | Okawa et al. | |
| 4,859,347 | A | 8/1989 | Simon et al. | |
| 4,998,415 | A | 3/1991 | Larsen | |
| 5,074,759 | A | 12/1991 | Cossairt | |
| 5,083,429 | A | 1/1992 | Veres et al. | |
| 5,205,648 | A | 4/1993 | Fissenko | |
| 5,275,486 | A | 1/1994 | Fissenko | |
| 5,317,905 | A | 6/1994 | Johnson | |
| 5,338,113 | A | 8/1994 | Fissenko | |
| 5,343,711 | A * | 9/1994 | Kornhauser et al. | 62/500 |
| 5,353,602 | A | 10/1994 | Pincus | |
| 5,431,346 | A | 7/1995 | Sinaisky | |
| 5,439,560 | A | 8/1995 | Kurematsu et al. | |
| 5,467,613 | A | 11/1995 | Brasz | |
| 5,544,961 | A | 8/1996 | Fuks et al. | |
| 5,647,221 | A | 7/1997 | Garris, Jr. | |
| 5,659,173 | A | 8/1997 | Putterman et al. | |
| 5,770,019 | A | 6/1998 | Kurematsu et al. | |
| 5,810,037 | A | 9/1998 | Sasaki et al. | |
| 5,980,698 | A | 11/1999 | Abrosimov et al. | |
| 6,105,382 | A | 8/2000 | Reason | |
| 6,170,289 | B1 * | 1/2001 | Brown et al. | 62/511 |
| 6,190,498 | B1 | 2/2001 | Blagborne | |
| 6,241,160 | B1 | 6/2001 | Redford | |
| 6,280,578 | B1 | 8/2001 | Popov | |
| 6,398,918 | B1 | 6/2002 | Popov | |
| 6,604,376 | B1 | 8/2003 | Demarco et al. | |
| 6,655,165 | B1 | 12/2003 | Eisenhour | |
| 6,719,817 | B1 | 4/2004 | Marin | |
| 6,739,141 | B1 | 5/2004 | Sienel et al. | |
| 6,796,704 | B1 | 9/2004 | Lott | |
| 6,835,484 | B2 | 12/2004 | Fly | |
| 6,889,754 | B2 | 5/2005 | Kroliczek et al. | |
| 6,935,845 | B2 | 8/2005 | Berner et al. | |
| 7,004,240 | B1 | 2/2006 | Kroliczek et al. | |
| 7,061,763 | B2 | 6/2006 | Tsoi | |
| 7,086,823 | B2 | 8/2006 | Michaud | |
| 7,131,294 | B2 | 11/2006 | Manole | |
| 7,178,353 | B2 | 2/2007 | Cowans et al. | |
| 7,251,889 | B2 | 8/2007 | Kroliczek et al. | |
| 7,381,241 | B2 | 6/2008 | Tessien et al. | |
| 7,387,093 | B2 | 6/2008 | Hacsi | |
| 7,387,660 | B2 | 6/2008 | Tessien et al. | |
| 7,393,342 | B2 | 7/2008 | Henniges et al. | |
| 7,399,545 | B2 | 7/2008 | Fly | |
| 7,415,835 | B2 | 8/2008 | Cowans et al. | |
| 7,448,790 | B2 | 11/2008 | Tessien et al. | |
| 7,549,461 | B2 | 6/2009 | Kroliczek et al. | |
| 7,654,095 | B2 | 2/2010 | Sullivan | |
| 7,656,808 | B2 | 2/2010 | Manthoulis et al. | |
| 7,708,053 | B2 | 5/2010 | Kroliczek et al. | |
| 7,721,569 | B2 | 5/2010 | Manole | |
| 7,726,135 | B2 | 6/2010 | Sullivan | |
| 7,765,820 | B2 | 8/2010 | Cowans et al. | |
| 7,796,389 | B2 | 9/2010 | Edmunds et al. | |
| 8,087,880 | B2 | 1/2012 | Karafillis et al. | |
| 8,333,080 | B2 | 12/2012 | Harman et al. | |
| 8,353,168 | B2 | 1/2013 | Harman et al. | |
| 8,353,169 | B2 | 1/2013 | Harman et al. | |
| 8,359,872 | B2 | 1/2013 | Harman et al. | |
| 8,365,540 | B2 | 2/2013 | Harman et al. | |
| 8,505,322 | B2 | 8/2013 | Gielda et al. | |
| 8,506,254 | B2 | 8/2013 | Muller | |
| 8,820,114 | B2 | 9/2014 | Charamko et al. | |
| 2001/0042380 | A1 | 11/2001 | Cho et al. | |
| 2002/0090047 | A1 | 7/2002 | Stringham | |
| 2002/0177035 | A1 | 11/2002 | Oweis et al. | |
| 2003/0085296 | A1 | 5/2003 | Waxmanski | |
| 2003/0126883 | A1 | 7/2003 | Saito et al. | |
| 2004/0009382 | A1 | 1/2004 | Fly | |
| 2004/0123614 | A1 | 7/2004 | Stewart | |
| 2004/0172966 | A1 * | 9/2004 | Ozaki et al. | 62/500 |
| 2005/0005617 | A1 | 1/2005 | Jibb | |
| 2005/0039626 | A1 | 2/2005 | Yi et al. | |
| 2005/0048339 | A1 | 3/2005 | Fly | |
| 2006/0018419 | A1 | 1/2006 | Tessien | |
| 2006/0018420 | A1 | 1/2006 | Tessien | |
| 2006/0032625 | A1 | 2/2006 | Angelis et al. | |
| 2006/0191049 | A1 | 8/2006 | Elkins et al. | |
| 2007/0010339 | A1 | 1/2007 | Stone | |
| 2007/0028646 | A1 | 2/2007 | Oshitani et al. | |
| 2007/0199333 | A1 | 8/2007 | Windisch | |
| 2007/0271939 | A1 | 11/2007 | Ichigaya | |
| 2008/0006051 | A1 | 1/2008 | Johnson | |
| 2008/0057382 | A1 | 3/2008 | Kimura | |
| 2008/0060378 | A1 | 3/2008 | Gocho et al. | |
| 2008/0105315 | A1 | 5/2008 | Botros et al. | |
| 2008/0277098 | A1 | 11/2008 | Fly | |
| 2008/0292948 | A1 | 11/2008 | Kumar et al. | |
| 2009/0199997 | A1 | 8/2009 | Koplow | |
| 2009/0266516 | A1 | 10/2009 | Jewell-Larsen et al. | |
| 2009/0272128 | A1 | 11/2009 | Ali | |
| 2009/0293513 | A1 | 12/2009 | Sullivan | |
| 2010/0043633 | A1 | 2/2010 | Galbraith | |
| 2010/0090469 | A1 | 4/2010 | Sullivan | |
| 2010/0126212 | A1 | 5/2010 | May | |
| 2010/0154445 | A1 | 6/2010 | Sullivan | |
| 2010/0180631 | A1 | 7/2010 | Roisin et al. | |
| 2010/0287954 | A1 | 11/2010 | Harman et al. | |
| 2011/0030390 | A1 | 2/2011 | Charamko et al. | |
| 2011/0048048 | A1 | 3/2011 | Gielda et al. | |
| 2011/0048062 | A1 | 3/2011 | Gielda et al. | |
| 2011/0048066 | A1 | 3/2011 | Gielda et al. | |
| 2011/0051549 | A1 | 3/2011 | Debus et al. | |
| 2011/0052369 | A1 | 3/2011 | Michaud | |
| 2011/0088419 | A1 | 4/2011 | Harman et al. | |
| 2011/0088878 | A1 | 4/2011 | Harman et al. | |
| 2011/0094249 | A1 | 4/2011 | Harman et al. | |
| 2011/0117511 | A1 | 5/2011 | Harman et al. | |
| 2011/0139405 | A1 | 6/2011 | Harman et al. | |
| 2012/0000631 | A1 | 1/2012 | Charamko et al. | |
| 2012/0118538 | A1 | 5/2012 | Gielda et al. | |
| 2012/0205080 | A1 | 8/2012 | Debus et al. | |
| 2012/0260673 | A1 | 10/2012 | Charamko et al. | |
| 2012/0260676 | A1 | 10/2012 | Charamko et al. | |
| 2012/0285661 | A1 | 11/2012 | Gielda et al. | |
| 2012/0297800 | A1 | 11/2012 | Debus et al. | |
| 2012/0301268 | A1 | 11/2012 | Gielda et al. | |
| 2012/0312379 | A1 | 12/2012 | Gielda et al. | |
| 2014/0054161 | A1 | 2/2014 | Harman et al. | |
| 2014/0174113 | A1 | 6/2014 | Harman et al. | |

FOREIGN PATENT DOCUMENTS

| | | |
|---|---|---|
| GB | 2 473 981 | 2/2012 |
| JP | 60-175980 | 9/1985 |
| JP | 2002130770 | 5/2002 |
| JP | 2003021410 | 1/2003 |
| JP | 2003034135 | 2/2003 |
| JP | 2005-240689 | 9/2005 |
| JP | 2009-221883 | 10/2009 |
| SU | 1312348 | 5/1987 |
| WO | 2004072567 A2 | 8/2004 |
| WO | WO 2006/054408 | 5/2006 |
| WO | 2006137850 A2 | 12/2006 |
| WO | 2009070728 A1 | 6/2009 |
| WO | 2009123674 A2 | 10/2009 |
| WO | 2010042467 A2 | 4/2010 |
| WO | WO 2010/111560 | 9/2010 |

(56) References Cited

FOREIGN PATENT DOCUMENTS

| | | |
|---|---|---|
| WO | WO 2011/119338 | 9/2011 |
| WO | WO 2012/018627 | 2/2012 |
| WO | WO 2012/065169 | 5/2012 |
| WO | WO 2012/097192 | 7/2012 |
| WO | WO 2012/097193 | 7/2012 |
| WO | WO 2013/070254 | 5/2013 |
| WO | WO 2014/058417 | 4/2014 |

OTHER PUBLICATIONS

PCT Application No. PCT/US2010/28761, International Preliminary Report on Patentability mailed Aug. 19, 2011, 5pgs.
PCT Application No. PCT/US2011/027845, International Search Report mailed Jul. 25, 2011, 4pgs.
U.S. Appl. No. 12/960,979 Final Office Action mailed May 19, 2011.
U.S. Appl. No. 12/960,979 Interview Summary mailed Mar. 16, 2011.
U.S. Appl. No. 12/961,015 Interview Summary mailed Mar. 10, 2011.
U.S. Appl. No. 12/961,342 Final Office Action mailed May 17, 2011.
U.S. Appl. No. 12/961,342 Interview Summary mailed Jul. 13, 2011.
U.S. Appl. No. 12/961,342 Interview Summary mailed Mar. 18, 2011.
U.S. Appl. No. 12/961,386 Office Action mailed Mar. 18, 2011.
Energy Efficiency Manual, "Compression Cooling," D.R. Wulfinghoff, 1999, pp. 1299-1321.
M.Guglielmone et al., Heat Recovery from Vapor Compression Air Conditioning: A Brief Introduction, Turbotec Products, Inc., May 14, 2008.
Robert H. Turner, "Water Consumption of Evaporative Cooling Systems," 21st Intersociety Energy Conservation Engineering Conference, San Diego, California, Aug. 25-29, 1986.
S. Klein et al., "Solar Refrigeration," American Society of Heating, Refrigerating and Conditioning Engineers, Inc., Ashrae Journal, vol., 47 No. 9, Sep. 2005.
NASA Tech Briefs, "Vapor-Compression Solar Refrigerator Without Batteries," Sep. 2001, http://www.techbriefs.com/component/content/article/7426.
Wikipedia, "Stirling engine," http://en.wikipedia.org/wiki/Stirling_engine, visited May 3, 2010.
Fox, et al., "Supersonic Cooling by Shock-Vortex Interaction," J. Fluid Mech. 1996, vol. 308, pp. 363-379.
Hu, et al., "Numerical and Experimental Study of a Hydrodynamic Cavitation Tube," Metallurgical and Materials Transactions B, vol. 29B, Aug. 1998.
Mishra, et al., "Development of Cavitation in Refrigerant (R-123) Flow Inside Rudimentary Microfluidic Systems," Journal of Microelectromechanical Systems, vol. 15, No. 5, Oct. 2006.
Non-final office action mailed Feb. 4, 2011 in U.S. Appl. No. 12/960,979.
Non-final office action mailed Feb. 1, 2011 in U.S. Appl. No. 12/961,342.
Non-final office action mailed Feb. 16, 2011 in U.S. Appl. No. 12/961,015.
Combined search and examination report dated Jan. 21, 2011 in U.K. patent application No. GB1021925.1.
PCT Application No. PCT/US2012/021140, International Search Report mailed Jun. 12, 2012, 3pgs.
PCT Application No. PCT/US2012/021139, International Search Report mailed Aug. 14, 2012, 3pgs.
U.S. Appl. No. 12/732,171, Office Action mailed Jan. 23, 2012.
U.S. Appl. No. 12/876,985, Office Action mailed Feb. 29, 2012.
U.S. Appl. No. 12/880,940, Office Action mailed Sep. 19, 2012.
U.S. Appl. No. 12/902,056, Office Action mailed Sep. 14, 2012.
U.S. Appl. No. 12/902,060, Office Action Sep. 26, 2012.
U.S. Appl. No. 12/960,979, Office Action mailed Mar. 9, 2012.
U.S. Appl. No. 12/961,015, Office Action mailed Jul. 3, 2012.
U.S. Appl. No. 12/961,015, Final Office Action mailed Dec. 9, 2011.
U.S. Appl. No. 12/961,342, Office Action mailed Dec. 13, 2011.
U.S. Appl. No. 12/961/386, Final Office Action mailed Dec. 13, 2011.
PCT Application No. PCT/US11/45376 International Search Report and Written Opinion mailed Dec. 23, 2011.
PCT Application No. PCT/US11/060615 International Search Report and Written Opinion mailed Mar. 23, 2012.
PCT Application No. PCT/US2012/021140, Written Opinion mailed Jun. 12, 2012.
PCT Application No. PCT/US2012/021139, Written Opinion mailed Aug. 14, 2012.
Chinese Patent Application No. 2010-080022994.7, Office Action dated Aug. 14, 2013.
U.S. Appl. No. 12/753,824, Office Action mailed May 8, 2013.
U.S. Appl. No. 12/961,015, Final Office Action mailed Feb. 25, 2013.
U.S. Appl. No. 12/843,834, Office Action mailed Jul. 12, 2013.
U.S. Appl. No. 13/115,930, Office Action mailed Apr. 2, 2013.
PCT Application No. PCT/US2012/00544, International Search Report and Written Opinion Feb. 4, 2013.
PCT Application No. PCT/US2012/059405, International Search Report mailed Dec. 13, 2012.
U.S. Appl. No. 13/349,378 Office Action mailed Jul. 14, 2014.

* cited by examiner

HEAT EXCHANGE AND COOLING SYSTEMS

CROSS-REFERENCE TO RELATED APPLICATION

The present application is a continuation and claims the priority benefit of U.S. patent application Ser. No. 12/876,985, filed Sep. 7, 2010 now U.S. Pat. No. 8,365,540, which claims the priority benefit of U.S. provisional application No. 61/240,153 filed Sep. 4, 2009. The disclosures of each of these applications are incorporated herein by reference.

BACKGROUND OF THE INVENTION

1. Field of the Invention

The present invention generally relates to heat transfer including the transportation of heat energy. More specifically, the present invention is related to heating, ventilation, and air conditioning (HVAC) applications, especially liquid heating and cooling.

2. Description of the Related Art

There are many applications where it is desirable to move heat energy. For example, in the field of air-conditioning, heat energy is moved either out of or into a body of air within a building, vehicle, or other enclosed space. Such systems generally operate in the context of the co-efficient of performance (COP)—the ratio of the energy gained by the body of air relative to the energy input. Many air conditioning systems operate with a COP of 2 to 3.5.

Water heating also invokes various heat transportation applications. Many water heating systems rely upon the direct application of heat energy to a body of water in order to raise temperature. As a result, the COP of such systems is usually limited to 1. While water heating systems could theoretically be devised utilizing certain operating principles of air conditioning and refrigeration systems, the increased capital expenses of such a system typically are not justified by the corresponding gain in performance.

A vapor compression system, as found in many air-conditioning applications, generally includes a compressor, a condenser, and an evaporator. These systems also tend to include an expansion device. In a prior art vapor compression system, a gas is compressed whereby the temperature of that gas is increased beyond that of the ambient temperature. The compressed gas is then run through a condenser and turned into a liquid. The condensed and liquefied gas is then taken through an expansion device, which drops the pressure and the corresponding temperature. The resulting refrigerant is then boiled in an evaporator.

FIG. 1 illustrates a vapor compression system 100 as might be found in the prior art. In the prior art vapor compression system 100 of FIG. 1, compressor 110 compresses the gas to (approximately) 238 pounds per square inch (PSI) and a temperature of 190 F. Condenser 120 then liquefies the heated and compressed gas to (approximately) 220 PSI and 117 F. The gas that was liquefied by the condenser 120 is then passed through the expansion valve 130 of FIG. 1. By passing the liquefied gas through expansion value 130, the pressure is dropped to (approximately) 20 PSI.

A corresponding drop in temperature accompanies the drop in pressure, which is reflected as a temperature drop to (approximately) 34 F in FIG. 1. The refrigerant that results from dropping the pressure and temperature at the expansion value 130 is boiled at evaporator 140. Through boiling of the refrigerant by evaporator 140, a low temperature vapor results. Said vapor is illustrated in FIG. 1 as having (approximately) a temperature of 39 F and a corresponding pressure of 20 PSI.

The cycle related to the system 100 of FIG. 1 is sometimes referred to as the vapor compression cycle. Such a cycle generally results in a COP between 2.4 and 3.5. The COP, as reflected in FIG. 1, is the evaporator cooling power or capacity divided by compressor power. It should be noted that the temperature and PSI references that are reflected in FIG. 1 are exemplary and for the purpose of illustration.

FIG. 2 illustrates the performance of a vapor compression system similar to that illustrated in FIG. 1. The COP illustrated in FIG. 2 corresponds to a typical home or automotive vapor compression system (like that of FIG. 1) with an ambient temperature of (approximately) 90 F. The COP shown in FIG. 2 further corresponds to a vapor compression system utilizing a fixed orifice tube system.

A system like that described in FIG. 1 and further referenced in FIG. 2 typically operates at an efficiency rate or COP that is far below that of system potential. To compress gas in a conventional vapor compression system like that illustrated in FIG. 1 (100) typically takes 1.75-2.5 kilowatts for every 5 kilowatts of cooling power. This exchange rate is less than optimal and directly correlates to the rise in pressure times the volumetric flow rate. Degraded performance is similarly and ultimately related to performance (or lack thereof) by compressor 110.

Haloalkane refrigerants such as tetrafluoroethane (CH2FCF3) are inert gases that are commonly used as high-temperature refrigerants in refrigerators and automobile air conditioners. Tetrafluoroethane has also been used to cool over-clocked computers. These inert, refrigerant gases are more commonly referred to as R-134 gases. The volume of an R-134 gas can be 600-1000 times greater than the corresponding liquid, which evidences the need for an improved vapor compression system that more fully recognizes system potential and overcomes technical barriers related to compressor performance.

SUMMARY OF THE CLAIMED INVENTION

A first claimed embodiment of the present invention includes a heat transfer method. Through the method, cavitation is caused in a fluid flow in a first region thereby providing a multi-phase fluid with vapor bubbles. The cavitation may be caused by reducing the pressure. A localized drop in temperature of the multi-phase fluid may result as a consequence of the cavitation. The multi-phase fluid travels from the first location to a second location over a period of time during which heat energy is absorbed from a proximate heat source. The vapor bubbles are permitted to collapse in or after the second location.

A second claimed embodiment sets forth a heat transfer system. The system includes a flow path to reduce pressure at a first location in the flow path upon a liquid flowing within the flow path to promote production of vapor bubbles by cavitation, thereby producing a multi-phase fluid with a consequent drop in temperature. A heat exchanger transfers heat from a heat source to the multi-phase fluid over at least a portion of the flow path between a first location and a second location. The second location may be selected based on a substantial proportion of the vapor bubbles within the multi-phase fluid having not collapsed by the time the multi-phase fluid reaches the second location.

In various embodiments, the multi-phase fluid may travel at supersonic speed between a portion of the flow path between the first location and the second location. The flow path may include a fluid pathway within a heat transfer nozzle. The heat transfer nozzle may include an inlet portion, a throat portion, an expansion portion, and an outlet portion. Liquid entering the throat portion may be caused to cavitate thereby producing a multi-phase fluid with vapor bubbles, whereby the multi-phase fluid is caused to travel into and along the expansion portion before the vapor bubbles collapse. Heat energy may be received from a heat source as the multi-phase fluid passes along the expansion portion.

DETAILED DESCRIPTION

Figure 1:
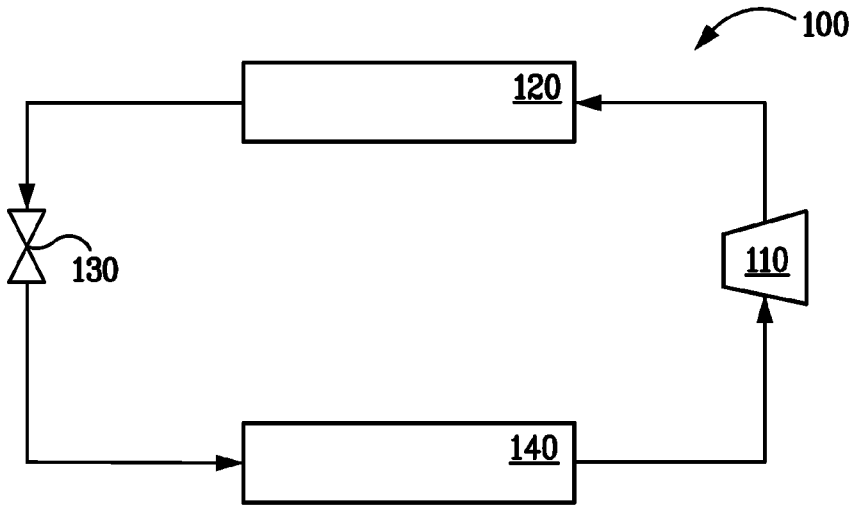
Prior Art FIG. 1
FIG. 1 is a schematic diagram of a vapor compression air-conditioning system as may be found in the prior art.
Figure 2:
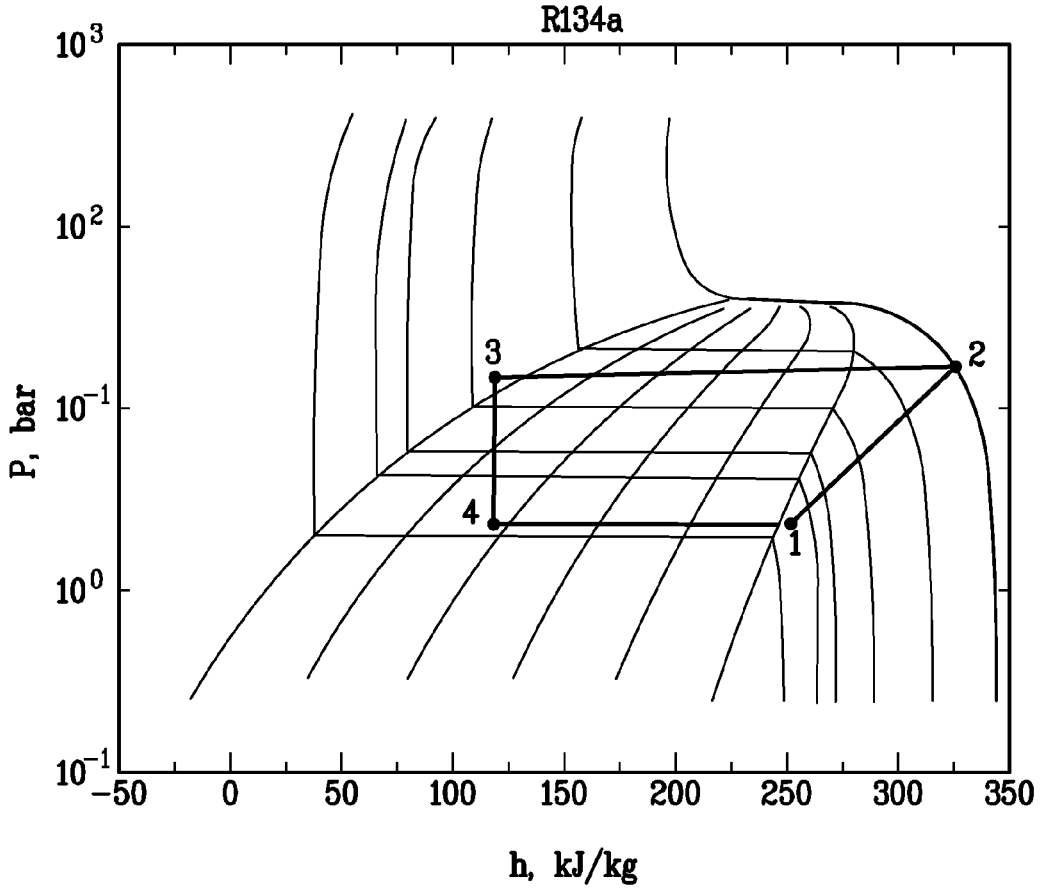
Prior Art FIG. 2
FIG. 2 is a pressure-enthalpy graph for a vapor compression air-conditioning system like that illustrated in FIG. 1.

In contrast to the prior art systems of FIGS. 1 and 2, various embodiments of the present invention may rely upon cavitation for its refrigeration cycle. Through inertial cavitation, bubbles of vapor may form in regions of a flowing liquid where the pressure is reduced below the vapor pressure. This may be especially true where the dynamic pressure is rapidly reduced.

Cavitation is generally regarded as a problem as it results in turbulence, wasted energy, and a shock wave caused when the bubbles collapse and return to the liquid phase. Cavitation can cause corrosion of mechanical items such as propellers and pipes. Engineers generally go to considerable lengths to avoid or minimize cavitation. In the present context, however, inertial cavitation may be used to provide a refrigeration cycle for use in various HVAC and heat transfer applications. Cavitation may include, but is not limited to, the creation of vapor bubbles within a liquid as a result of reduced pressure regardless of whether said reduction is spontaneous, at a seed particle or at a surface, and therefore is inclusive of nucleation.

Heat energy is transported by a multi-phase fluid including a liquid and vapor bubbles formed by cavitation when the pressure exerted on a portion of the liquid is reduced. The production of vapor from a liquid requires the input of heat energy. Where vapor bubbles are formed in substantial numbers, energy is initially taken from the liquid with the result that the temperature of the liquid falls. Vapor bubbles formed by cavitation collapse readily when the pressure returns above the vapor pressure of the liquid. Heat energy is released and as a result the temperature of the liquid rises.

Figure 3:
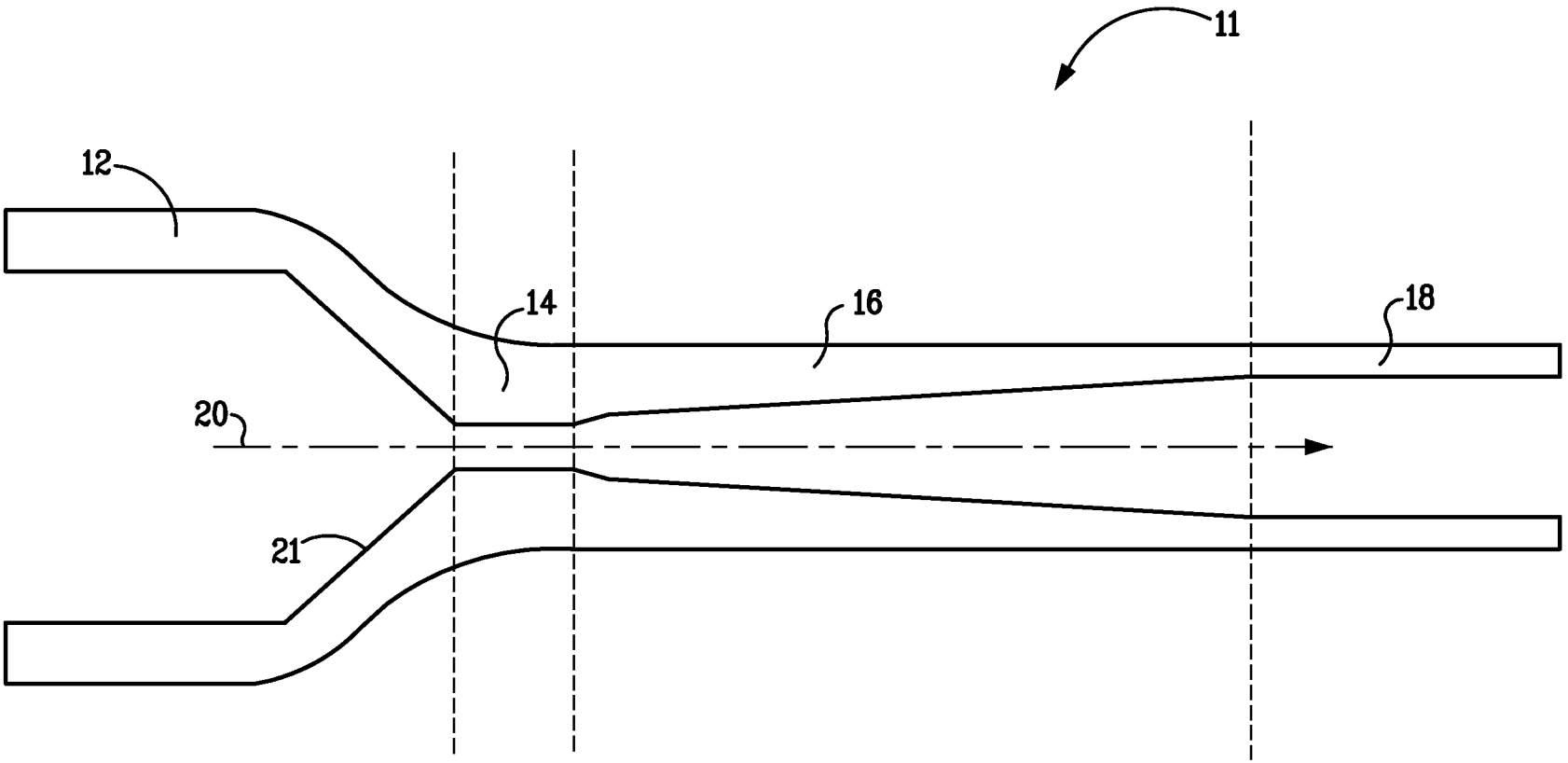
FIG. 3 is a cross-section of a heat transfer nozzle.

FIG. 3 is a cross-section of a heat transfer nozzle 11. Heat transfer nozzle 11 of FIG. 3 may be used in a commercial or residential air-conditioning system. The converging-diverging nozzle 11 of FIG. 3 includes an inlet portion 12, a throat portion 14, an expansion portion 16, an outlet portion 18, and a fluid pathway 20.

The inlet portion 12 receives liquid refrigerant from a pumped supply under pressure, typically in the range of 500 kPa to 2000 kPa. Pressures outside this range may be used for specialized applications. The liquid refrigerant is then directed into the throat portion 14 via a funnel-like or other converging exit 21.

The throat portion 14 provides a duct of substantially constant profile (normally circular) through its length through which the liquid refrigerant is forced. The expansion portion 16 provides an expanding tube-like member wherein the diameter of the fluid pathway 20 progressively increases between the throat portion 14 and the outlet portion 18. The actual profile of the expansion portion may depend upon the actual refrigerant used.

The outlet portion 18 provides a region where the refrigerant exiting the nozzle can mix with refrigerant at ambient conditions and thereafter be conveyed away. In use, when liquid refrigerant enters the throat portion, it is caused to accelerate to high speed. The pressure and diameter of the throat orifice may be selected so that the speed of the refrigerant at the entry of the throat orifice is approximately the speed of sound (Mach 1).

At the same time, the acceleration of the refrigerant causes a sudden drop in pressure which results in cavitation and commencing at the boundary between the funnel-like exit 21 of the inlet portion 12 and the entry to the throat orifice 14, but also being triggered along the wall of the throat orifice. Cavitation results in bubbles containing refrigerant in the vapor phase being present within the fluid, thereby providing a multi-phase fluid. The creation of such vapor bubbles requires the input of energy for the input of latent heat of vaporization and as a result the temperature falls. Meanwhile, the reduction in pressure together with the multiphase fluid results in the lowering of the speed of sound with the result that refrigerant exits the throat at supersonic speed of, for example, Mach 1.1 or higher. Within the expansion portion, the pressure continues at a low level and the fluid expands. As a result of the expansion, the flow accelerates further, reaching a speed in the order of approximately Mach 3 further along the expansion portion.

The thermodynamic performance of the nozzle 11 is explained below with reference to FIG. 4, which is a pressure-enthalpy graph for the heat transfer nozzle of FIG. 3. The diagram of FIG. 4 specifically uses water as the refrigerant.

Figure 4:
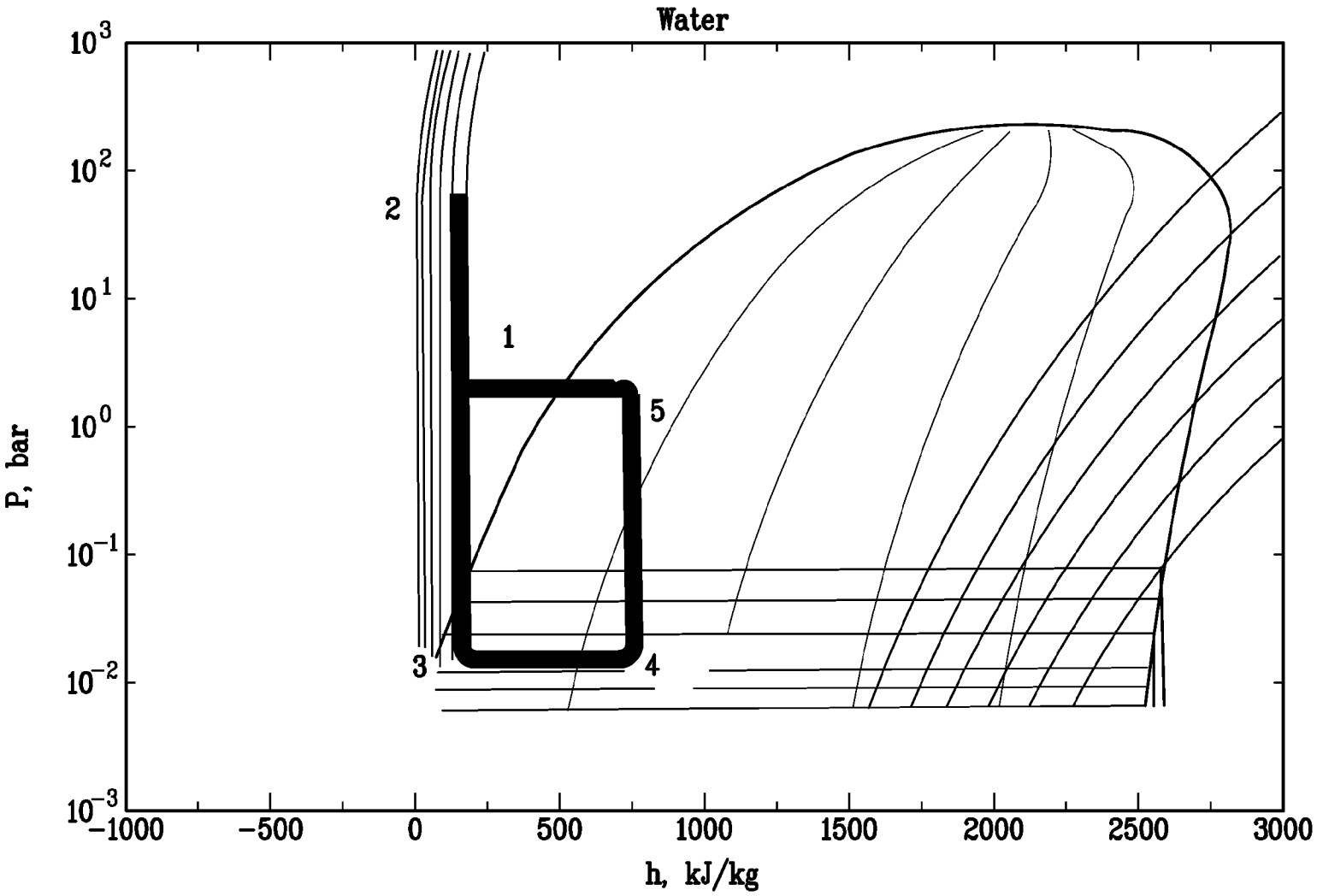
FIG. 4 is a pressure-enthalpy graph for the heat transfer nozzle of FIG. 3.

From step 1 to 2 in FIG. 4, water at low pressure is compressed to a range of to 20 bar. This may be accomplished with a positive displacement pump. The pump power is defined as:

$$\text{Pump}_{power}=Q*\Delta P$$

where Q is the volumetric flow rate and ΔP is the pressure rise across the pump. Since the volumetric flow rate Q for liquid water is orders of magnitude less than the water vapor, significant energy is saved in this phase compared with a vapor compression system.

From step 2 to 3 in FIG. 4, the high pressure water flows through the converging-diverging nozzle 11. In the high speed region, the flow begins to cavitate, resulting in a significant reduction in the localized speed of sound. The reduction in the localized sound speed will change the character of the flow from traditional incompressible flow to a regime more compatible with high speed nozzle flow.

Figure 5:
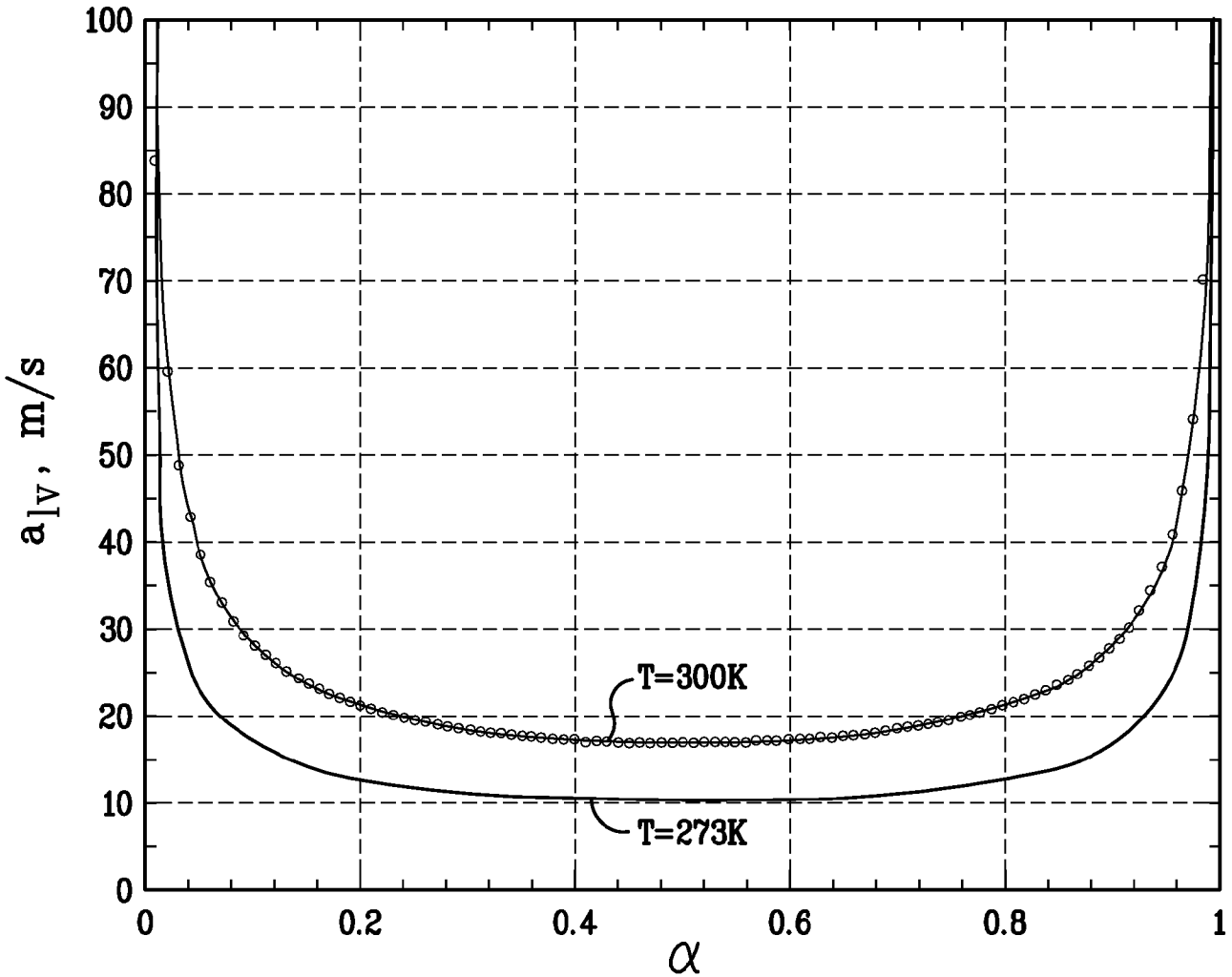
FIG. 5 is a graph illustrating the local sound speed of water as a function of water vapor void fraction in accordance with the heat transfer nozzle of FIG. 3.

FIG. 5 is a graph illustrating the local sound speed of water as a function of water vapor void fraction in accordance with the heat transfer nozzle of FIG. 3. The sound speed is orders of magnitude smaller in the presence of bubbles/vapor. The local sound speed as a function of void fraction is defined by:

$$\frac{1}{c^2} = (\rho_L(1-\alpha_V) + \rho_v\alpha_V)\left(\frac{(1-\alpha_V)}{\rho_L c_L^2} + \frac{\alpha_V}{\rho_v c_v^2}\right)$$

where c denotes the speed of sound and L and V represent the liquid and vapor phases respectively. Once the flow speed exceeds the local sound speed the downstream pressure conditions cannot propagate upstream. In this condition, the flow now behaves like a supersonic nozzle and the parabolic nature of the governing equations can be taken advantage of in order to drive the saturation temperatures down, thereby providing cooling potential.

From step 3 to 4 in FIG. 4, the fluid rapidly accelerates and continues to drop in pressure. As the local static pressure drops, more water vapor is generated from the surrounding liquid. As the fluid passes below the saturation line the cold sink required for the cooling method is generated and the flow is behaving as if it was in an over expanded jet. Once the fluid has picked up sufficient heat, and due to frictional losses, it shocks back to a subsonic condition.

Figure 6:
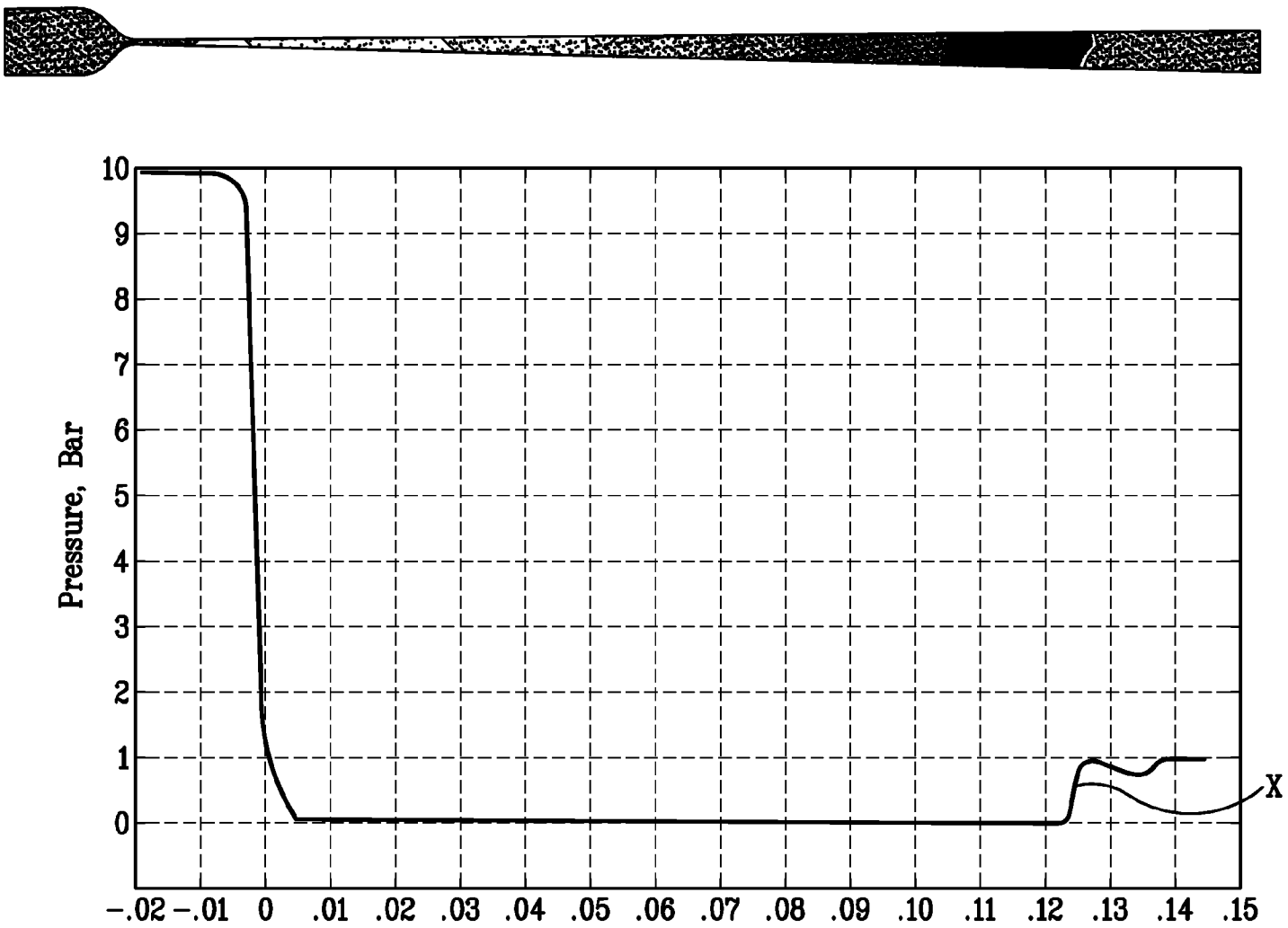
FIG. 6 is a diagram of the void fraction contours and graph of the center line pressure trace down the cooling channel of the heat transfer nozzle of FIG. 3.

An example of this methodology is shown in FIG. 6, which is a diagram of the void fraction contours and graph of the center line pressure trace down the cooling channel of the heat transfer nozzle of FIG. 3. Fluid enters the upstream converging-diverging nozzle at 10 bar; the pressure at the outlet is 1 bar. The fluid accelerates through the throat and initiates cavitation. Post throat, the flow behaves as a supersonic flow due to reduced sound speed and increases in speed and experiences a subsequent further reduction in pressure, resulting in further cooling. Further downstream the fluid continues to boil off absorbing heat from the secondary loop, until it reaches the point X at which it shocks back to outlet conditions.

Figure 7:
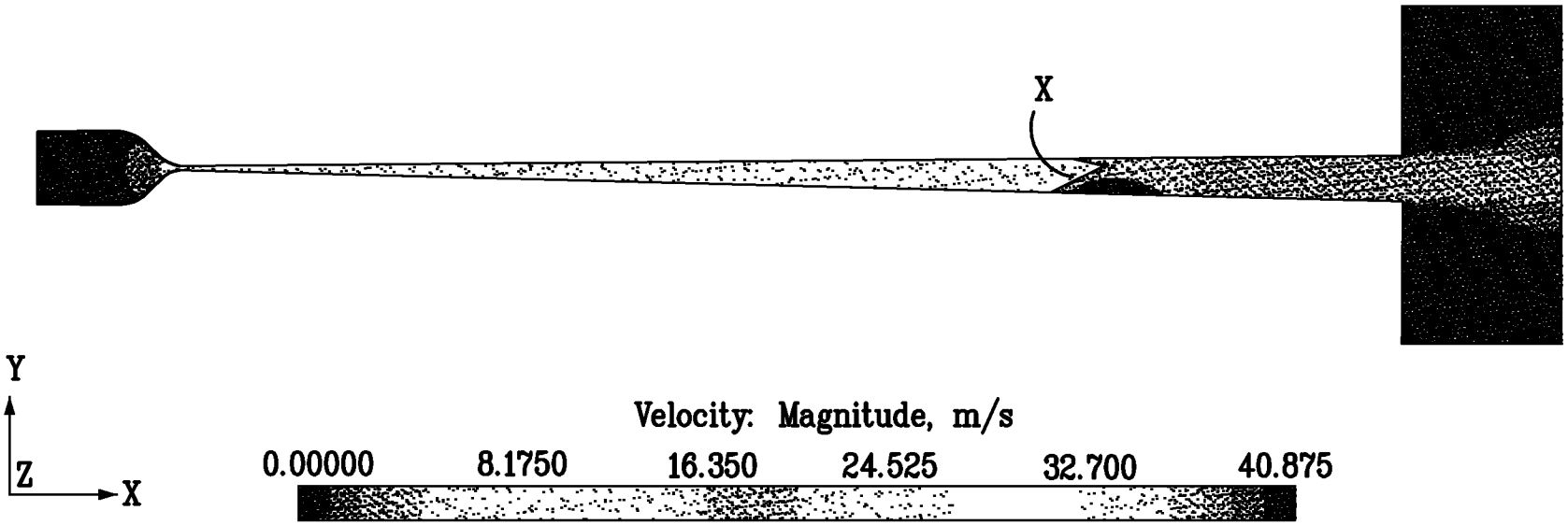
FIG. 7 is a diagram of the velocity contours near the post condensation shock in the heat transfer nozzle of FIG. 3.
Figure 8:
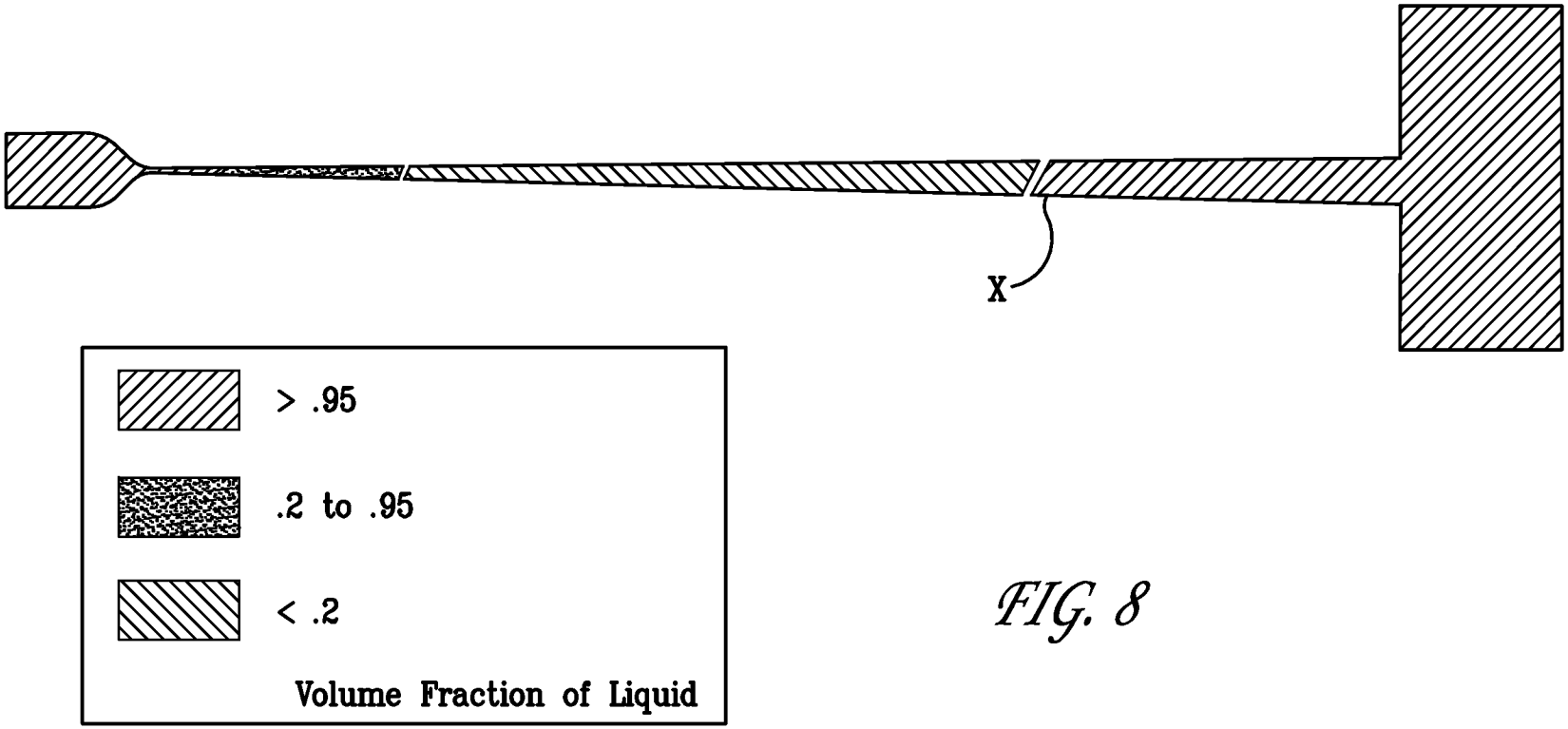
FIG. 8 is a diagram of the void fraction contours near post condensation shock in the heat transfer nozzle of FIG. 3.

From step 4 to 5 of FIG. 4, the fluid shocks back up to the ambient pressure as shown at point X in FIGS. 6, 7, and 8. The fluid is then expelled back into the main reservoir. This shock method is predicted by utilizing quasi-one dimensional flow equations with heat and mass transfer. The post shock predictions clearly depict a temperature rise due to heat addition from the heating load, plus the irreversible losses of the pump and friction. In an air-conditioning system, the hot fluid ejected from the cooling tubes is mixed with the bulk fluid to further minimize vapor volume. An example of this method is shown in FIGS. 7 and 8.

FIG. 7 is a diagram of the velocity contours near the post condensation shock in the heat transfer nozzle of FIG. 3. The pressure at the inlet of FIG. 7 equals 10 bar and the pressure at the reservoir (ambient) equals 1 bar. The fluid continues to accelerate with increasing cross-sectional area indicating that supersonic flow has been achieved in the post throat region. FIG. 8 is a diagram of the void fraction contours near post condensation shock in the heat transfer nozzle of FIG. 3. The pressure at the inlet of FIG. 8 equals 10 bar and the pressure at the reservoir (ambient) equals 1 bar.

Under these operating conditions, all vapor is condensed in the tube. The shock position is controlled by inlet pressure, heat input along the tube, and reservoir back pressure. It is important to note that since the flow in the tube is critical/choked that the impact of backpressure applies to the shock location and does not impact the operating pressure in the tube. In this regard, and finally at step 5 and returning to step 1 in FIG. 4, the heat added to the cooling fluid is rejected to the ambient environment via the exterior wall surface or through a secondary internal heat exchanger.

Figure 9:
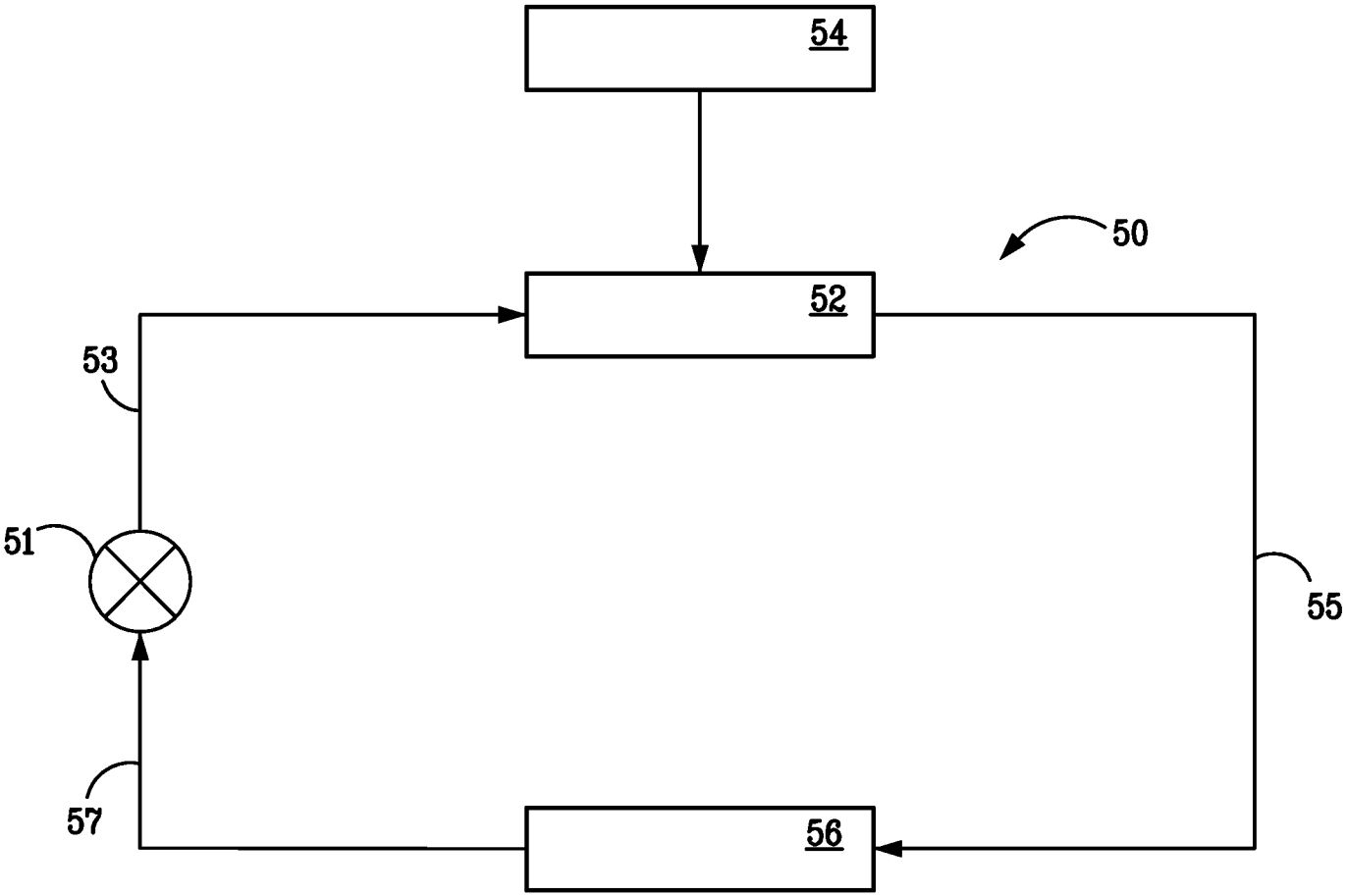
FIG. 9 illustrates a schematic diagram for an air-conditioning system in accordance with one or more embodiments of the present invention.

FIG. 9 illustrates a schematic diagram for an air-conditioning system 50 in accordance with one or more embodiments of the present invention; for example, an air-conditioning system, which includes the embodiment of FIG. 3. As shown in FIG. 9, the air-conditioning system 50 includes a positive displacement pump 51, which pumps refrigerant through line 53 to the heat transfer nozzle 52 (nozzle 11). A first heat exchanger 54 receives heat energy from the region to be cooled and transfers that energy to the nozzle 52 at which it is received by the refrigerant during the time during which the refrigerant is in multi-phase.

As discussed previously, the multi-phase fluid "shocks up" to ambient conditions within the nozzle 52 so that the heat transfer method is completed when the refrigerant leaves the nozzle 52. The heated refrigerant is transferred to a second heat exchanger 56 through a line 55 where the absorbed heat energy is removed. The refrigerant is then returned to the pump 51 via line 57.

Figure 10:
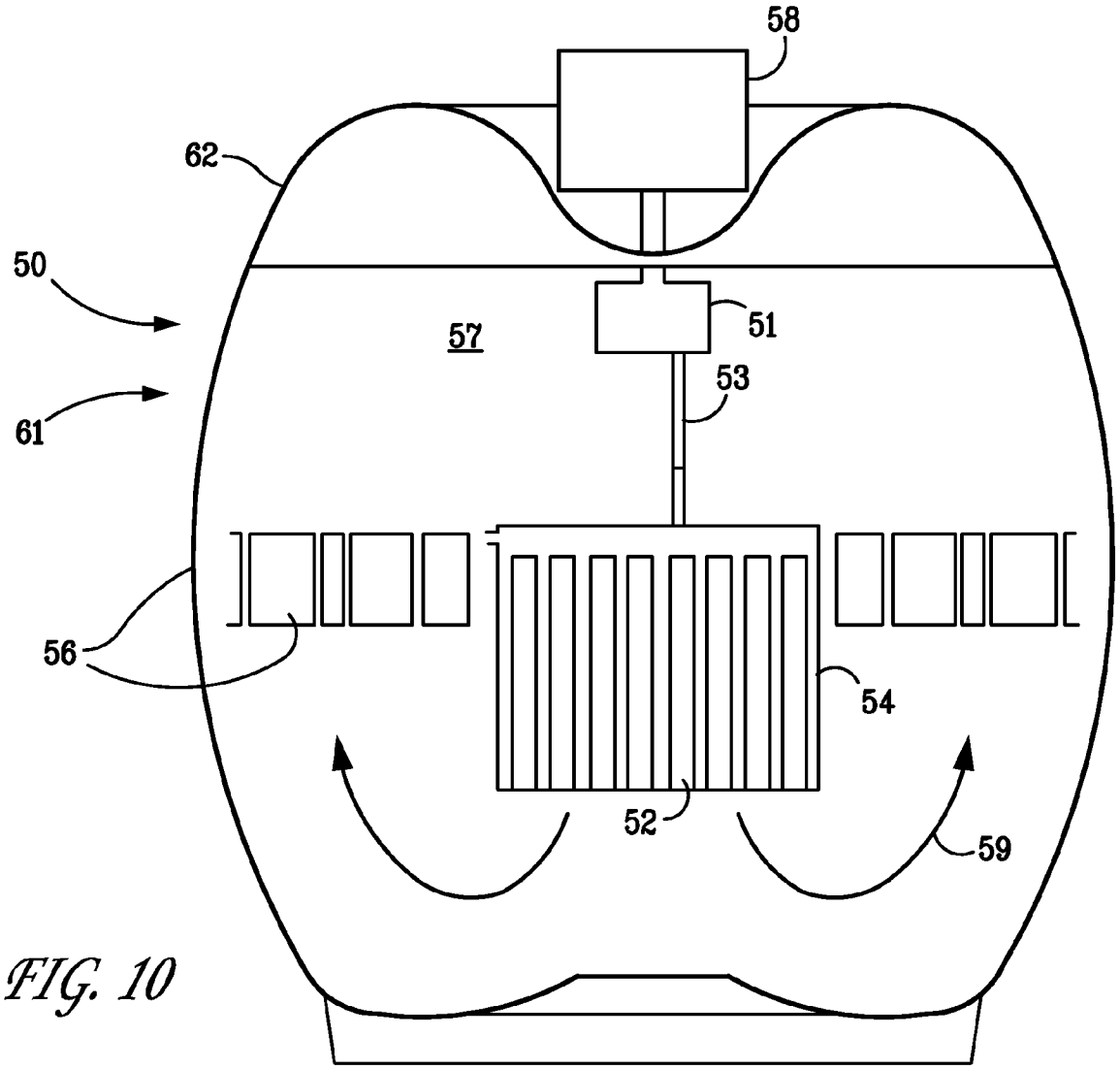
FIG. 10 is a diagrammatic representation of the air-conditioning system of FIG. 9.

FIG. 10 is a diagrammatic representation of the air-conditioning system of FIG. 9. In FIG. 10, components with the functions described in FIG. 9 are identified with the same numerals. The air-conditioning system 61 as shown in FIG. 10 includes a housing 62. The housing 62 promotes fluid flow around the housing and, in the presently disclosed embodiment, has a shape that is akin to a pumpkin. The pump 51 is located inside the housing 62 near the upper central wall. The pump 51 is driven by a motor 58, which is outside the housing 62 and connects to the pump 51 by an axle (not shown) and that penetrates the housing 62 via a bearing and seal.

The air-conditioning system 61 is sized to provide cooling greater than can be provided with a single heat exchange nozzle, and therefore cooling is achieved by a plurality of heat exchange nozzles arranged in parallel proximate the central region of the housing 62. This is an easy and cost effective arrangement due to the relatively small size of the single heat exchange unit. All units are supplied from a manifold fed from the pump.

The housing 62 stores a substantial volume of refrigerant, which may be applicable when water is the refrigerant. As is indicated by arrows 59, refrigerant exits the nozzles into the refrigerant reservoir and then circulates around the housing 62. The walls of the housing 62 become at least part of the second heat exchanger to dispel the heat which is absorbed into the refrigerant in the nozzles. Additional external heat exchangers may be added if necessary in the application.

In the system 50 of FIG. 10, refrigerant R-134a may be utilized. The heat transfer nozzle 11 of FIG. 3 may be adapted for use with most known refrigerants and it is, therefore, envisioned that there will be applications where other refrigerants will be preferred to water. The rate of expansion of the expansion portion must be selected appropriately for any given refrigerant selection.

Figure 11A:
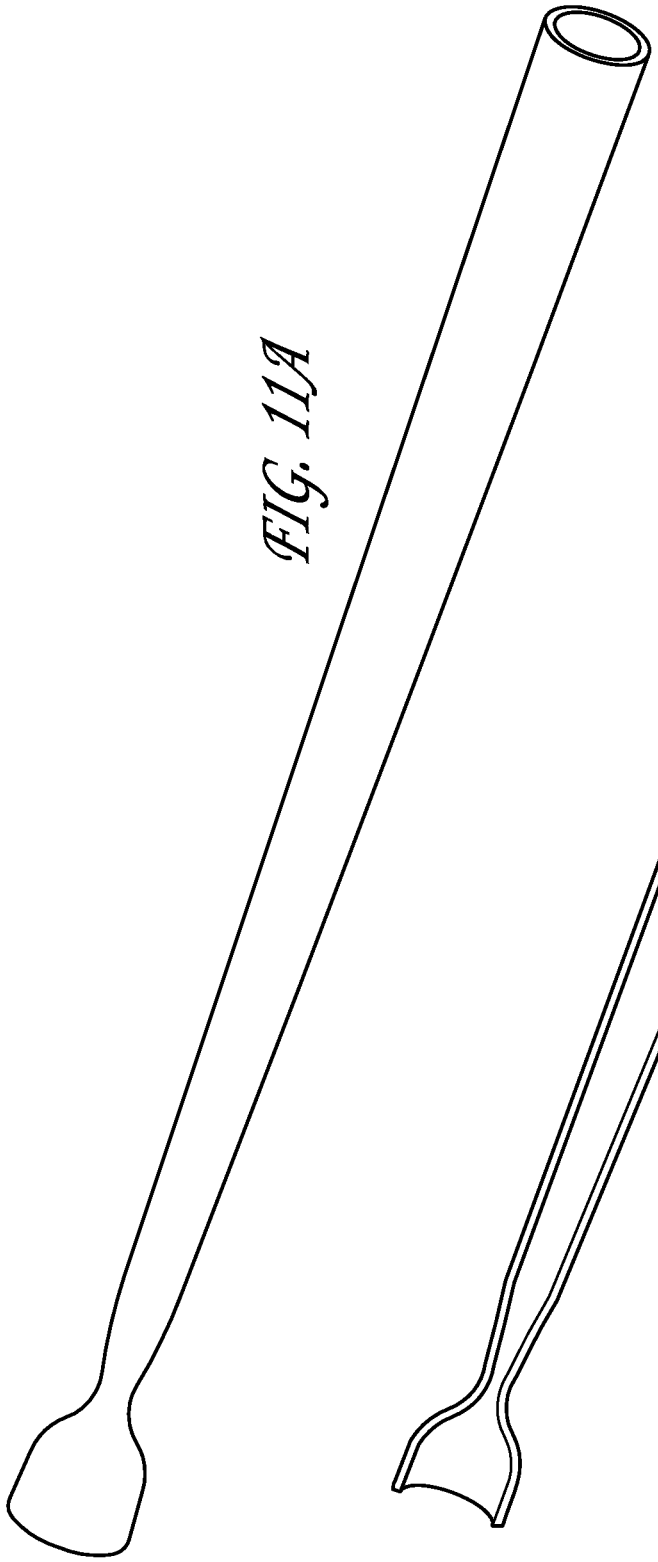
FIG. 11*a* illustrates a heat transfer nozzle as might be used in the system of FIG. 9.
Figure 11B:
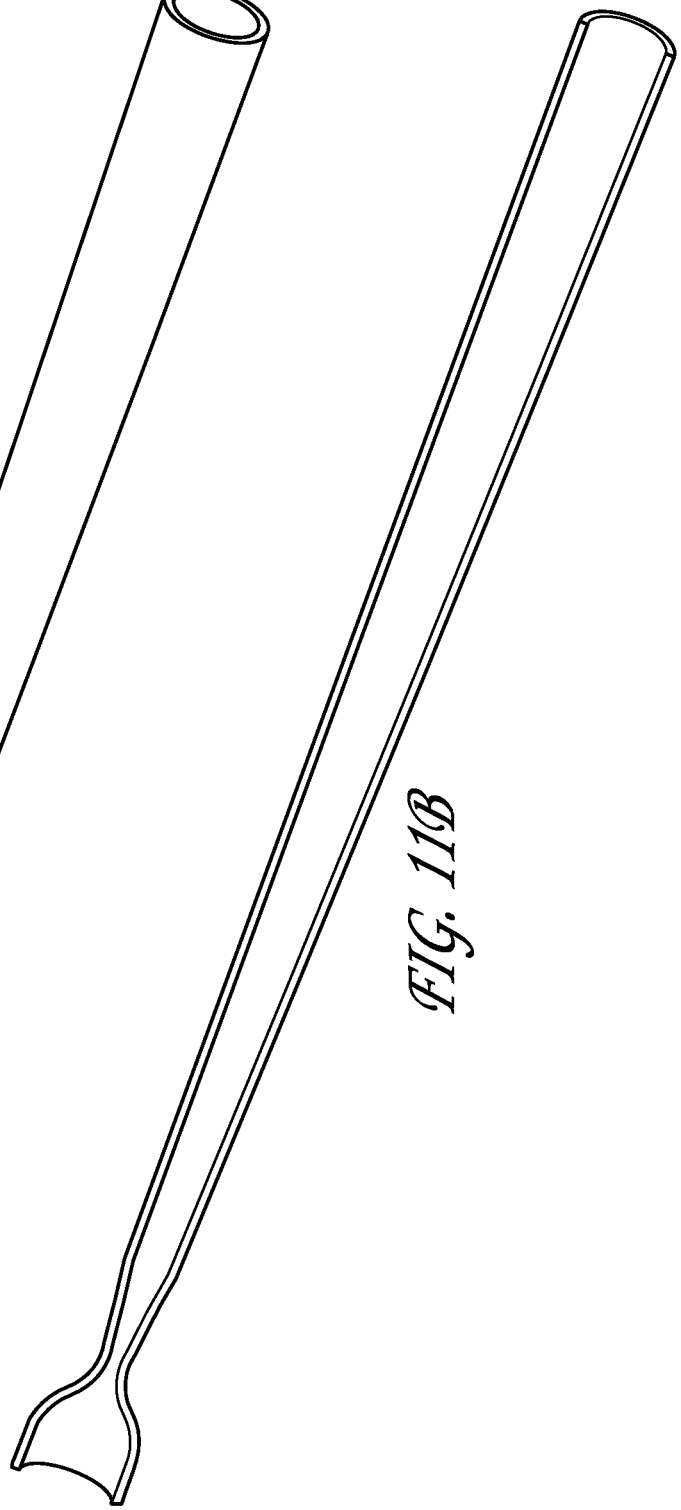
FIG. 11*b* illustrates a cut-await view of the heat transfer nozzle of FIG. 11*a*.

For example, the volumetric expansion of refrigerants such as R-123a and R-134a are considerably less than that of water, and it is therefore necessary to reduce the rate of expansion in the expansion portion. For R-134a refrigerants, the expansion half-angle (the angle between the central axis of the nozzle and the wall of the expansion portion) may be on the order of 1°. For R-123a, on the other hand, the half-angle may be on the order of 5° while, for water, the angle is even larger. A nozzle as may be suitable for R-134a is illustrated in FIGS. 11*a* and 11*b*, which illustrate a heat transfer nozzle and cutaway view, respectively. It may be noted that the size of this angle plays a role in the operation of the heat exchange nozzle.

Figure 12:
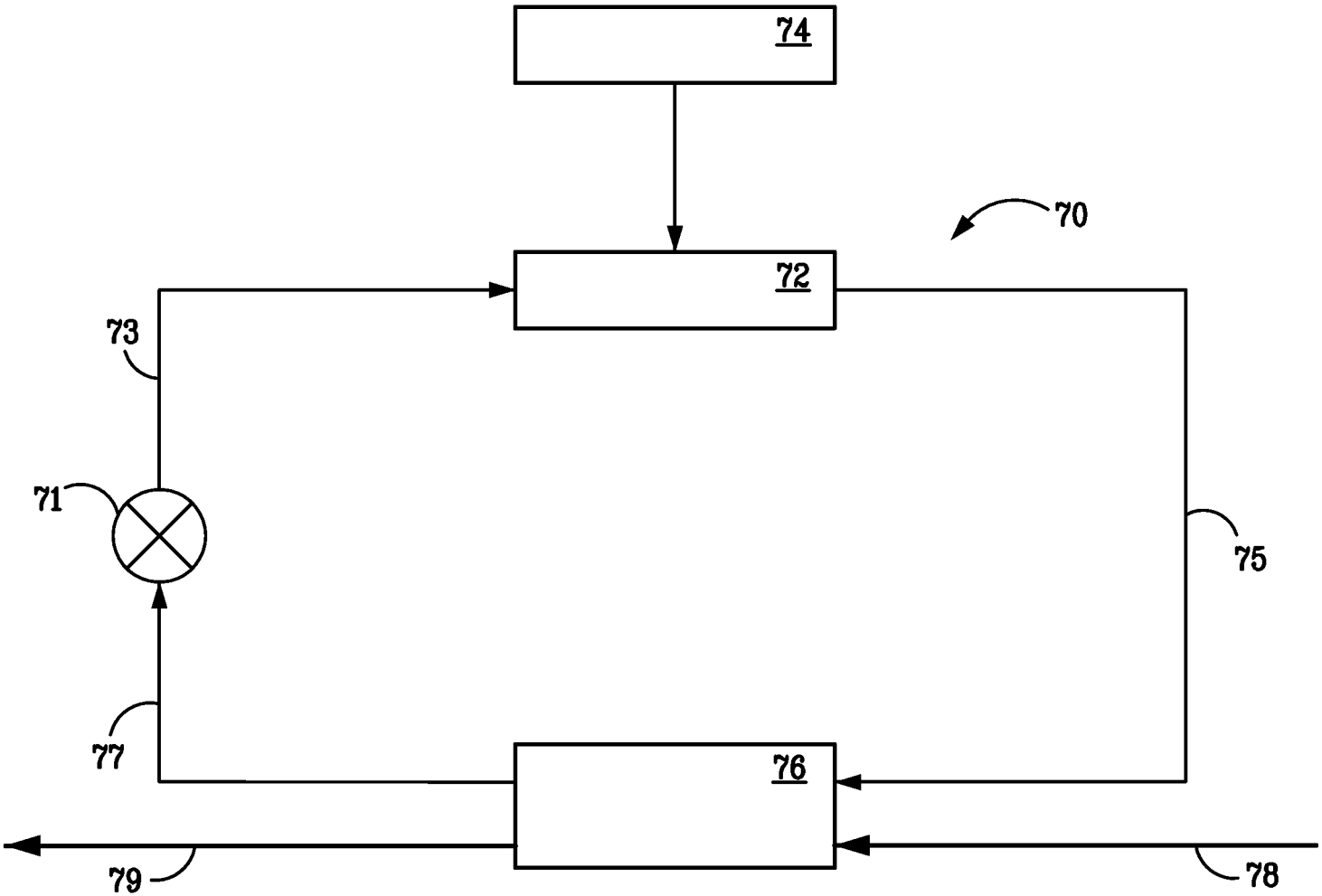
FIG. 12 illustrates a water heating system in accordance with one or more embodiments of the present invention.

A still further embodiment is illustrated in FIG. 12, which is for a water heating system. As shown in FIG. 12, the water heating apparatus 70 includes a pump 71, a bank of nozzles 72 in parallel together with associated heat exchanger 74, a hot water storage tank 76, cold water inlet pipe 78, hot water outlet pipe 79, a control system (not shown), and circulation piping 73, 75, and 77. The water heating apparatus of FIG. 12 may be of the "storage" type.

As discussed with respect to FIG. 3, after the water passes along the expansion portion, it "shocks up" to ambient conditions, with most of the vapor bubbles collapsing. As a result, the temperature of the water rises. However, the water does not simply return to the temperature it was at before it entered the nozzle but rather is increased by the energy absorbed from the heat source. While the increase for water is only a few degrees, the energy absorbed is substantial. By circulating the water through the hot water storage tank through the heat transfer system, the water temperature will rise to the desired level. A thermal input level can be selected which will warm the water very quickly, while requiring much less power from the mains than existing systems.

The thermodynamics and mechanics of the present systems can be further enhanced through application of nanotechnology. This may be especially true in the context of water as a refrigerant. For instance, high heat transfer coefficients in the sonic multiphase cooling regime may be achieved. Application of highly conductive nano-particles to the flow may help increase the effective thermo-conductivity and enhance heat transfer rates. Inclusion of nano-particle agglomerate can have an effect on the cavitation phenomena in the throat.

While the present invention has been described with reference to exemplary embodiments, it will be understood by those skilled in the art that various changes may be made and equivalents may be substituted for elements thereof without departing from the true spirit and scope of the present invention. In addition, modifications may be made without departing from the essential teachings of the present invention. Various alternative systems may be utilized to implement the various methodologies described herein and various methods may be used to achieve certain results from the aforementioned systems.

What is claimed is:

1. A supersonic air conditioning system, comprising:

a converging-diverging nozzle that induces cavitation or nucleation in a liquid, thereby forming a multi-phase liquid that travels at supersonic speed in order to perform a cooling operation; and a pump that feeds the liquid into the converging-diverging nozzle without passing through a heater such that the only liquid flowing into the converging-diverging nozzle enters from the pump and wherein the pump and the converging-diverging nozzle are arranged in a closed circuit flow path.

2. The supersonic cooling system of claim 1, wherein the converging-diverging nozzle also reduces the pressure of the liquid.

3. The supersonic cooling system of claim 2, wherein the pump increases the pressure of the liquid prior to reducing the pressure of the liquid.

4. The supersonic cooling system of claim 1, wherein the converging-diverging nozzle forms a multi-phase liquid with a consequent drop in temperature.

5. The method of claim 1, wherein the liquid comprises water.

6. A air conditioning system, comprising:

a closed circuit flow path having a first location and second location, the second location downstream from the first location, wherein the flow path reduces the pressure of a fluid at the first location upon the fluid flowing within the flow path, and wherein the flow path promotes the production of vapor bubbles by cavitation and/or nucleation in order to perform a cooling operation;

a converging-diverging nozzle, the converging-diverging nozzle situated within the closed circuit flow path; and a pump that feeds the fluid into the converging-diverging nozzle without passing through a heater such that the only liquid flowing into the converging-diverging nozzle enters from the pump.

7. The cooling system of claim 6, wherein the converging-diverging nozzle produces a multi-phase fluid.

8. The cooling system of claim 7, wherein the multi-phase fluid is formed with a consequent drop in temperature.

9. The cooling system of claim 6, further comprising a heat exchanger that transfers heat from a heat source to a multi-phase fluid over at least a portion of the flow path between the first location and the second location.

10. The cooling system of claim 6, wherein the fluid comprises a liquid.

11. An air conditioning method for exchanging heat, comprising:

increasing the pressure of a working fluid with the aid of a pump, thereby generating a high pressure working fluid; and flowing the high pressure working fluid through a closed circuit fluid flow path which comprises a converging-diverging nozzle that induces boiling of the working fluid by cavitation and/or nucleation in order to perform a cooling operation, the high pressure working fluid provided to the closed circuit fluid flow path from the pump without passing through a heater such that the only liquid flowing into the converging-diverging nozzle enters from the pump.

12. The method of claim 11, wherein the fluid flow path forms a multi-phase fluid.

13. The method of claim 12, wherein the multi-phase fluid travels at supersonic speed in at least a portion of the fluid flow path.

14. The method of claim 12, wherein the multi-phase fluid travels from a first location to a second location over a period of time during which heat is absorbed by the multiphase fluid from a heat source.

15. The method of claim 11, wherein the working fluid comprises a liquid.

16. The method of claim 11, wherein the pressure of the working fluid is increased to 5 bar or higher.

17. The method of claim 16, wherein the pressure of the working fluid is increased to 10 bar or higher.

18. The method of claim 11, wherein fluid flow path decreases the pressure of the working fluid to the saturation pressure corresponding to the ambient temperature.

* * * * *